US005461782A

United States Patent [19]

Rauch

[11] Patent Number: 5,461,782

[45] Date of Patent: Oct. 31, 1995

[54] SHAVING KIT

[75] Inventor: Joseph A. Rauch, Tivon, Israel

[73] Assignees: P.I.D. Rauch Industrial Design Ltd., Tivon, Israel; Haim Zeleznik, Fresh Meadows, N.Y.

[21] Appl. No.: 196,644

[22] Filed: Feb. 15, 1994

[51] Int. Cl.[6] ..... B26B 21/44

[52] U.S. Cl. ..... 30/47; 30/84; 30/86; 30/125; 30/51

[58] Field of Search ..... 30/47, 85, 86, 30/84, 87, 124, 125, 41, 40, 40.2, 51, 90; 206/352, 354, 228, 235, 208; D28/45, 46, 47, 48; D6/526

[56] References Cited

U.S. PATENT DOCUMENTS

| | | | |
|---|---|---|---|
| 2,603,860 | 7/1952 | De Swart | 30/47 |
| 4,831,729 | 5/1989 | Beuchat | 30/86 |
| 4,996,772 | 3/1991 | Iten | 30/84 |
| 5,206,994 | 5/1993 | Lin | 30/47 |
| 5,269,062 | 12/1993 | Dallaire et al. | 30/86 |

*Primary Examiner*—Richard K. Seidel
*Assistant Examiner*—Allan M. Schrock
*Attorney, Agent, or Firm*—Kane, Dalsimer, Sullivan, Kurucz, Levy, Eisele and Richard

[57] ABSTRACT

A shaving kit comprises an openable, box-like body having a main portion and a lid, a blade assembly and a releasable connection for the blade assembly to said body. The body defines when closed, an inner space for housing shaving aids, in particular shaving gel or cream and optionally after-shave gel or cream, in suitably packaged form. The body has portions that match and interlock with portions of the blade assembly and is provided with a seat-shaped upper surface to support the blade assembly during the shaving operation. A hygienic cover is slidable over the blade assembly to protect the same when not in use.

3 Claims, 4 Drawing Sheets

SHAVING KIT

FIELD OF THE INVENTION

The invention relates to compact, reusable or disposable shaving kits, particularly for use on the part of travelers or hotel guests or the like.

BACKGROUND OF THE INVENTION

The art has devoted great attention to solving the problem of providing travelers with shaving kits, including what is necessary for one or a few shaves. Such kits are often included in airline pouches, often as a gift to travelers, or are provided by hotels to their guests, and the like. They usually contain a disposable razor and one or more containers of shaving aids, such as shaving cream or foam and after-shave cream tubes or bags, housed in a plastic envelope or the like.

While such kits are very widely used, their volume, shape and texture are not ideal. The necessity of housing in the same kit objects of very different natures, such as a razor and shaving aids containers, produces a relatively uncomfortable package, the volume of which is not the absolute minimum with respect to its content. Furthermore, the presence in the kit of relatively soft, objects, such as flexible plastic bags, makes these latter vulnerable, so to speak, to the presence of hard objects in the same kit or piece of luggage.

It is a purpose of this invention to provide a compact shaving kit, which contains razor means and shaving cream or the like, which is free from all the drawbacks of prior art kits.

It is a more specific object to provide such a kit which is outwardly rigid and therefore protects any soft objects contained therein, such as shaving aids tubes or bags.

It is another object of the invention to provide such a kit which may be disposable or may be reused, if desired, by providing flesh shaving blades and/or aids.

It is a further object of the invention to provide such a kit that has a volume which is close to the absolute minimum possible.

It is a still further object of the invention to provide such a kit which is economical to make.

It is a still further object of the invention to provide such a kit which is easy to carry and will not become damaged from contact with hard objects that may be contained in the same piece of luggage.

It is a still further object of the invention to provide such a kit which may include, if desired, spare blades.

Other purposes and advantages of the invention will appear as the description proceeds.

SUMMARY OF THE INVENTION

The shaving kit according to the invention is characterized in that it comprises an openable, box-like body; a blade assembly (of the single blade or double blade or any other desired type); and means for connecting said blade assembly to said body; said body defining, when closed, an inner space for housing shaving aids, in particular shaving gel or cream and optionally after-shave gel or cream, in suitably packaged form.

Said means for connecting said blade assembly and said body are preferably releasable to permit substitution of said blade assembly, when it has become dulled through use.

Further, said means for connecting said body to said blade assembly preferably comprise members solid with and more preferably integral with said body, having portions that match and interlock with portions of said blade assembly.

In a preferred embodiment of the invention, said body is provided with a seat-shaped upper surface to support said blade assembly during the shaving operation.

In a preferred embodiment of the invention, said kit comprises hygienic cover means to be slid over said blade assembly to protect the same when not in use, and a gap is preferably provided between said blade assembly, when connected to said body and the upper surface of this latter, to permit cover means to be slid over said blade assembly.

Said body preferably comprises a main portion and a lid, frictionally engaged with one another, when the body is closed to define said inner space, and is preferably made of molded plastic, said members comprised in said means for connecting said body to said blade assembly being preferably molded in one piece with said main body portion.

DETAILED DESCRIPTION OF PREFERRED EMBODIMENTS

Figure 1:
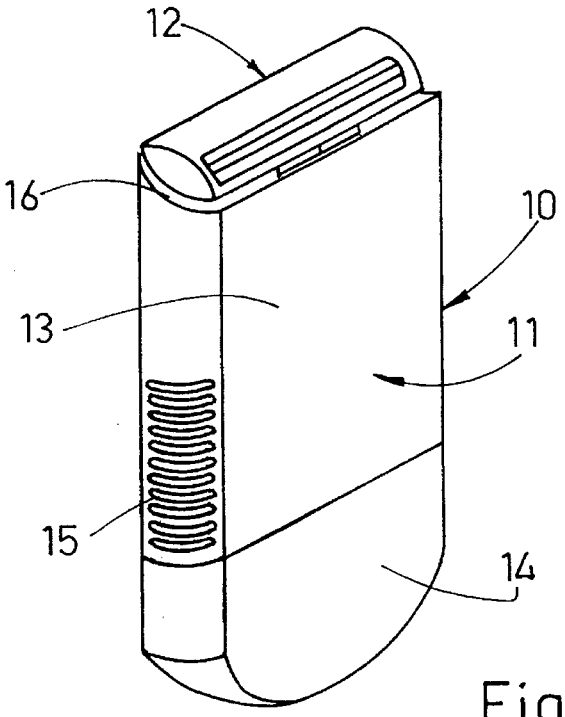
FIG. 1 is a perspective view of a shaving kit according to an embodiment of the invention, the cover of the blade assembly being omitted.
Figure 2:
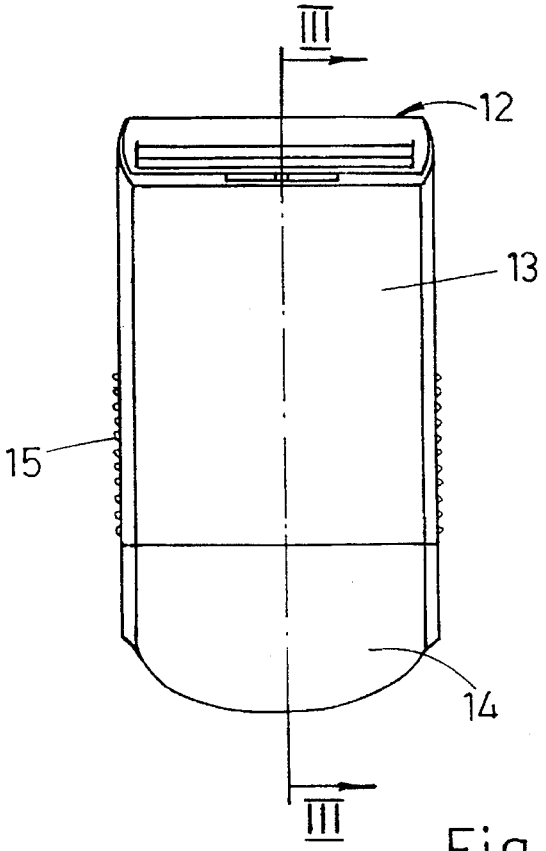
FIG. 2 is a front view of the kit of FIG. 1.

With reference now to the drawings, numeral 10 generally indicates a shaving kit according to an embodiment of the invention. Said kit comprises a body 11 and a blade assembly 12.

The body 11 comprises two portions, a main portion 13 and a lid 14. The main body portion 13 preferably is provided with projections 15 or the like elements, to afford the user a better grip when carrying out the shaving operation. The connection between main body portion 13 and cover 14 is preferably a frictional connection. The entire body 11 is preferably made, more preferably by molding, of suitable plastic matter.

Figure 6A:
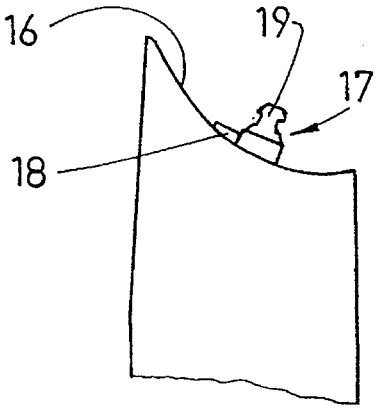
FIG. 6(*a*) is a side view, at an enlarged scale, of the upper part of the main body portion of FIG. 5, and FIG. 6(*b*) is a detail thereof, at a further enlarged scale.
Figure 6B:
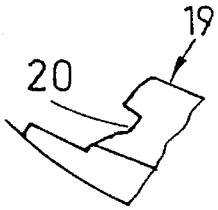

The main body portion 13 is provided on its top with a curved surface 16 (hereinafter called the seat surface) which is shaped to correspond to the lower surface of the blade assembly and provide a support for this latter when the shaving operation is carried out. At the center of said seat surface 16 are provided members 17—better illustrated in FIG. 6(*b*) which are part of means for connecting the blade assembly 12 to the body. Said members 17 are constituted, in this embodiment, by projections that may be of any suitable structure, but they are preferably solid, more preferably integral, with the body 11, so that they may be molded in one operation with it, to render the whole kit as inexpensive as possible. The connecting means further comprise members that are part of the blade assembly and which match and interlock, preferably in a resilient manner, with said members 17, as will be better explained hereinafter. The precise structure of the matching and interlocking elements of the connecting means, hereinafter described, is merely illustrative, as many other suitable structures may be devised and used by persons skilled in the art, without exceeding the scope of the invention. In the embodiment described, the members 17 comprise a base 18 with an upwardly projecting portion, which in this embodiment is constituted by two shoulders 19, which are preferably provided with grooves 20 to facilitate connection with the blade assembly, as will be better explained hereinafter. It will be understood that, instead of the two shoulders 19, only one or more than two projections could be provided and be shaped in any convenient way. The connecting means thus illustrated may be substituted by any other suitable connecting means, in particular, such means as will permit an elastically swingable connection between blade assembly and body 11, if such a connection is desired, according to the particular blade applied.

Figure 7:
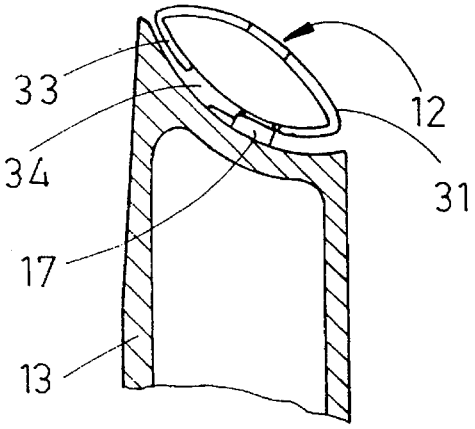
FIG. 7 is a cross-section on the same plane as that of FIG. 3, at an enlarged scale, of the upper part of the kit of FIG. 1, on which the cover of the blade assembly has been mounted.
Figure 8:
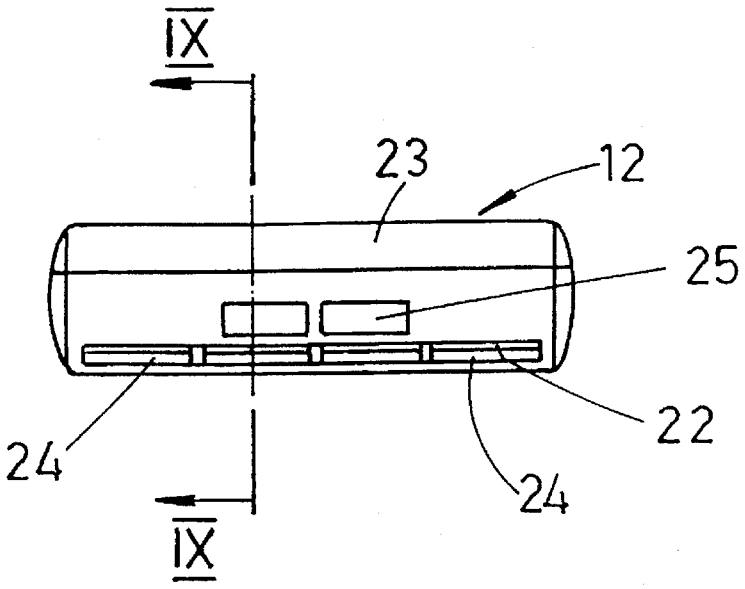
FIG. 8 is a plan view of the blade assembly of said shaving kit, seen from the bottom, at an enlarged scale.
Figure 9:
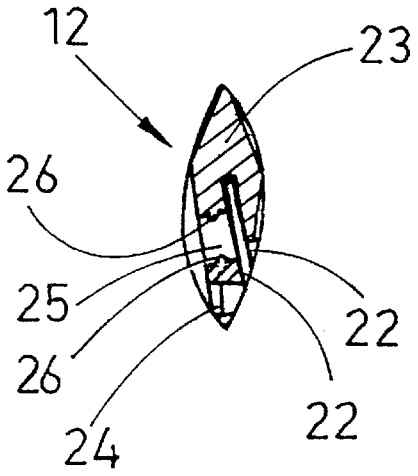
FIG. 9 is a cross-section of said blade assembly, taken on the plane IX—IX of FIG. 8.

The blade assembly 12 is approximately lens-shaped in cross-section, as seen in FIGS. 7 and 9, but may have any other suitable cross-section. It houses blades 22, two of them in the embodiment described, mounted on a base 23, preferably made of plastic, and provided with discharge slits 24. However, the blade assembly may be structured in any suitable way, and the art includes many such possible structures that may be adopted in carrying out the invention. Means are provided in base 23 for connecting blade assembly 12 to body 11 through connecting means 17. Preferably, such means consist merely of slits into which connectors 17 of the main body portion 13 may be inserted. In the particular embodiment described, since connectors 17 comprise two projections 19 having grooves 20 therein, two corresponding slits 25 are provided in base 23 for receiving said projections, and within said slits ribs 26 are formed in said base, which fibs are so shaped as to fit in grooves 20 of projections 19. In this way, blade assembly 12 may be connected to body 11 merely by inserting said projections 19 into said slits 25 and pressing the two parts together until fibs 26 resiliently snap into grooves 20. However, as has been said, the connecting means provided on the body 11 and on the blade assembly 12, and specifically on its base 23, may be of any desired type, and may include spring and/or sliding means, although connectors such as those described have the advantage of being easy and economical to provide.

The seat surface, shape and dimensions are suited to the particular blades applied.

Figure 3:
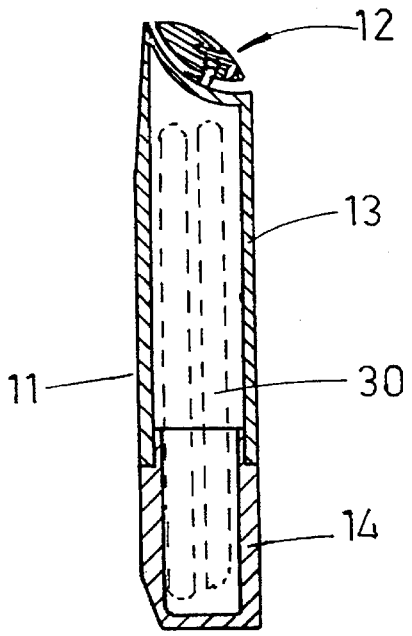
FIG. 3 is a vertical cross-section of said kit, taken on plane III—III of FIG. 2.
Figure 4:
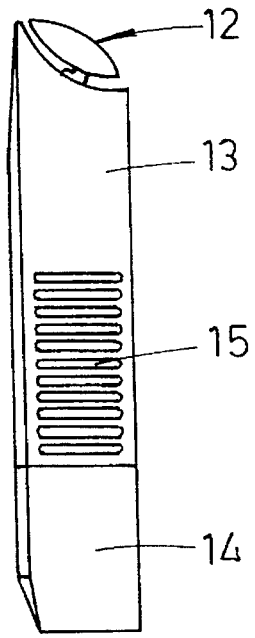
FIG. 4 is a lateral vertical view of said kit.
Figure 5:
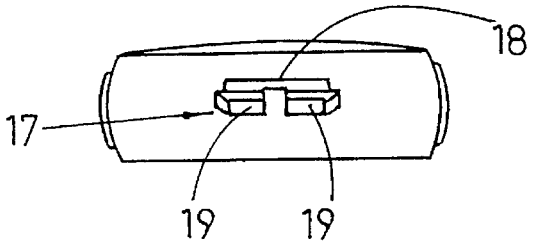
FIG. 5 is a plan view of the body of said shaving kit, the blade assembly having been removed.

Within the cavity 30 of body 11, when the body is closed, shaving aids are housed, and these may conveniently include shaving gel, cream or oil, after shave towelettes, gel or cream and any other means that can be housed within said cavity 30 of body 11. The particular nature of these aids, as well as the kind of packages in which they are enclosed, can be freely chosen by the persons carrying the invention into practice, it being only necessary that they may be housed in cavity 30. In FIG. 3, the outlines of two such packages are shown in broken lines for purposes of illustration only, said packages having the form of bags or pouches, tubes, ampoules and the like, of any suitable flexible material, such as plastic, waterproof paper, aluminum foil, paper-plastic laminates, and the like. Additionally or alternatively, spare blades or blade assemblies may be housed in cavity 30, and this is an additional advantage of the kit according to the invention over those of the prior art.

A cover 31 is preferably provided to protect the blade assembly when not in use (see FIG. 7), and this is preferably shaped, as seen, in such a way as to partially envelope the blade assembly, without interfering with the connectors thereof to the body. As shown in this particular embodiment, the cover has wings 33 underlying the blade assembly, which fit within the gap 34 between said blade assembly and seat surface 16. The cover may be slid sideways away and onto the blade assembly, which cannot become displaced in this direction, as the connectors 17 will only permit removal of the blade assembly away from body 11, but not mutual sliding thereof. The blade assembly and the blade cover may alternatively be mounted by snap-on action or by other means of assembly.

While an embodiment of the invention has been described by way of illustration, it will be apparent that the invention may be carried into practice with many modifications, variations and adaptations by persons skilled in the art, without departing from its spirit or exceeding the scope of the appended claims.

I claim:

1. Shaving kit comprising an openable box-like body having a main body portion and a snap-on lid; a blade assembly; and means for providing a snap-on connection of said blade assembly to said main body portion, said main body portion being provided with an arcuate seat-shaped upper surface to support said blade assembly during the shaving operation.

2. Shaving kit according to claim 1, which further comprises hygienic cover means to be slid or snapped-on over said blade assembly to protect the same when not in use.

3. Shaving kit according to claim 2, wherein a gap is provided between said blade assembly, when connected to said main body portion, and the upper surface, to permit said cover means to be mounted over said blade assembly and removed therefrom.

* * * * *